US008770949B2

(12) United States Patent
Noble

(10) Patent No.: US 8,770,949 B2
(45) Date of Patent: Jul. 8, 2014

(54) CEILING FAN

(75) Inventor: Ernest John Noble, Selangor (MY)

(73) Assignee: Delta T Corporation, Lexington, KY (US)

( * ) Notice: Subject to any disclaimer, the term of this patent is extended or adjusted under 35 U.S.C. 154(b) by 437 days.

(21) Appl. No.: 13/061,781

(22) PCT Filed: Sep. 4, 2008

(86) PCT No.: PCT/IB2008/002590

§ 371 (c)(1),
(2), (4) Date: Mar. 2, 2011

(87) PCT Pub. No.: WO2010/026441

PCT Pub. Date: Mar. 11, 2010

(65) Prior Publication Data

US 2011/0165002 A1 Jul. 7, 2011

(51) Int. Cl.

| | |
|---|---|
| ***F04B 17/00*** | (2006.01) |
| ***F04B 35/04*** | (2006.01) |
| ***F01D 5/00*** | (2006.01) |
| ***F01D 25/00*** | (2006.01) |
| ***F03B 1/02*** | (2006.01) |
| ***F03B 11/00*** | (2006.01) |
| ***F04D 29/00*** | (2006.01) |
| ***H05K 5/00*** | (2006.01) |

(52) U.S. Cl.
USPC ..... 417/410.1; 417/411; 416/244 R; 416/5; 454/184

(58) Field of Classification Search
USPC ..... 417/410.1, 411, 423.7; 416/1, 244 R, 5; 415/198.1; 454/184
See application file for complete search history.

(56) References Cited

U.S. PATENT DOCUMENTS

| | | | | |
|---|---|---|---|---|
| 4,073,598 | A * | 2/1978 | Mizutani et al. | 416/5 |
| 4,592,702 | A * | 6/1986 | Bogage | 416/247 R |
| 4,721,480 | A * | 1/1988 | Yung | 439/527 |
| 5,135,365 | A * | 8/1992 | Bogage | 417/423.15 |
| 5,154,579 | A * | 10/1992 | Rezek | 416/5 |
| D341,881 | S | 11/1993 | Smith et al. | |
| 5,319,821 | A | 6/1994 | Nicholson et al. | |
| 5,332,364 | A * | 7/1994 | Rodarmer | 416/146 R |
| 5,421,701 | A * | 6/1995 | Funston | 416/5 |
| 5,507,619 | A | 4/1996 | Ryan | |
| 5,586,867 | A * | 12/1996 | Mehlos | 417/45 |

(Continued)

OTHER PUBLICATIONS

International Search Report (PCT/IB2008/002590), dated Jun. 3, 2009.

*Primary Examiner* — Devon Kramer
*Assistant Examiner* — Lilya Pekarskaya
(74) *Attorney, Agent, or Firm* — King & Schickli, PLLC

(57) ABSTRACT

A ceiling fan comprising: a fan motor and blade assembly, a mounting tube for suspending the fan motor and blade assembly from a ceiling, and a power supply mounted within the mounting tube configured to power the fan motor. Also a ceiling fan comprising a moulded stator frame, a raised turret integrally moulded within the frame configured to enclose and mount a motor controller, and an external user changeable auxiliary module. Also ceiling fan comprising: a totally enclosed safety extra low voltage fan motor assembly configured to be suspended from an upper side, and a sealing arrangement within the assembly providing a substantial degree of ingress protection against dust and water incident from at least an under side. Also a method comprising providing a ceiling fan comprising moulded stator frame, and mounting an external user changeable auxiliary module to a raised turret integrally moulded within the frame.

28 Claims, 13 Drawing Sheets

(56) References Cited

U.S. PATENT DOCUMENTS

| | | | | |
|---|---|---|---|---|
| 5,738,496 | A | 4/1998 | Mehta | |
| 6,062,816 | A * | 5/2000 | Chang | 416/5 |
| 6,095,767 | A | 8/2000 | Caughey | |
| 6,158,964 | A * | 12/2000 | Gajewski | 416/244 R |
| 6,183,201 | B1 | 2/2001 | Maby | |
| 6,799,982 | B2 * | 10/2004 | Kerr, Jr. | 439/180 |
| 7,232,336 | B1 | 6/2007 | Evans | |
| 7,276,814 | B2 * | 10/2007 | Pozzuoli et al. | 307/77 |
| 7,422,163 | B1 * | 9/2008 | DeVorss | 239/289 |
| 7,626,299 | B2 * | 12/2009 | Yoshikawa et al. | 310/114 |
| 7,876,560 | B2 * | 1/2011 | Huang | 361/695 |
| 8,147,182 | B2 * | 4/2012 | Aynsley et al. | 415/119 |
| 8,622,712 | B2 * | 1/2014 | Wiegel et al. | 417/14 |
| 2009/0208333 | A1 * | 8/2009 | Smith et al. | 416/5 |

* cited by examiner

CEILING FAN

FIELD

The present invention relates to ceiling fans, particularly though not solely to a modular Totally Enclosed Non-Ventilated (TENV) ceiling fan driven by an Electronically Commutated (EC) motor with a separated Safety Extra Low Voltage (SELV) Switched Mode Power Supply (SMPS).

BACKGROUND

Existing ceiling fans are typically powered by high pole number AC induction motors, operating directly from the utility AC line voltage at high degrees of frequency slip, which makes operation very inefficient. Typical domestic ceiling fans may be optimised for low cost and long life, but not electrical efficiency. For example a typical domestic ceiling fan consumes around 75 W of electrical input power, but only generates around 15 W of mechanical shaft power; an efficiency of just 20%. The balance of 60 W is consumed almost entirely by electrical losses and is dissipated as heat within the motor housing.

For an AC induction motor, significant losses are incurred by generating the rotor magnetic poles, which are formed by electromagnets powered from the incoming ac line supply. While rotor losses occur in all AC induction motors, they form a higher proportion of total losses in a ceiling fan motor because of the relatively low mechanical shaft power.

In addition to consuming excessive electricity, the wasted energy is largely dissipated as heat causing substantial temperature rise within the motor, particularly at low speeds where the airflow is substantially reduced.

To keep motor temperature rise within acceptable limits, ceiling fan motors are typically provided with ventilation holes to allow airflow through the motor interior for cooling. Ventilated covers are provided external to the motor to prevent user access to live wiring, but still allowing airflow.

Since ceiling fan blades and other components are constantly exposed to circulating room air currents carrying household dust, over time dust is deposited most noticeably on the blades and on the upper motor cover. These require regular cleaning. Cleaning is more frequently required if the fan is located in a food service area where hygiene is important, and where the air may carry additional particles of grease and/or oil making removal of dust from the fan surfaces more difficult.

Dusting with a dry cloth or brush is a common method for dust removal from surfaces. However, the process of dusting contributes to airborne dust levels by disturbing dust particles from the surface and failing to capture them in the cleaning cloth. Since the ceiling fan is necessarily mounted above head height, disturbed dust particles can be spread over a wide area and thus present more potential for irritation to sufferers of asthma and allergies than if disturbed at floor level.

Various inventors have proposed solutions to this issue, including; a Ceiling Fan Cleaning Apparatus (U.S. Pat. No. 5,319,821); a Safety Blade For Ceiling Fan (U.S. Pat. No. 6,183,201); Ceiling Fan Dust Collector Cover For Blades (D341881). None of these address the issue of thoroughly cleaning the entire ceiling fan in a manner which is both safe and effective.

The amount of dust disturbed during cleaning can be greatly reduced by using a damp or wet cloth which captures the dust particles before they spread. To further aid in removal where the dust is contaminated with oil or grease particles, use of warm water and a suitable mild cleaning agent is preferred.

However traditional ceiling fan manufacturers' typically warn against using water during cleaning due to the risk of electric shock to the user, and/or damage to the motor. This restriction on wet cleaning applies even to fans specifically rated for use in damp or wet areas, since these fans are tested only for water ingress in the most typical direction for the installation, which is generally rainwater falling from above, rather than being cleaned from below.

So, there is a need for a ceiling fan which resolves these difficulties by allowing the use of water during the cleaning process, without risking damage to the fan or presenting an electrical shock risk to the user.

SUMMARY OF THE INVENTION

The present invention in general terms may resolve one or more of the deficiencies in existing ceiling fans by using a high efficiency Electronically Commutated (EC) motor in a Totally Enclosed Non-Ventilated (TENV) design. An EC motor has rotor poles provided by permanent magnetic materials, such as Ceramic or Neodymium Iron Boron, which do not consume any electrical power. This allows an EC ceiling fan motor to run with substantially lower losses than a comparatively rated AC induction motor. By appropriate selection of motor dimensions an EC ceiling fan system with overall efficiency of 60% may be produced, for example, using 25 W of electrical input power to generate 15 W of mechanical shaft power.

The lower power loss of the EC motor may substantially reduce the requirement for cooling, and may allow the motor to be totally enclosed without ventilation holes. Additionally the motor outer housing or enclosure may be manufactured from injection moulded thermoplastic materials having thermal conductivity at least an order of magnitude lower than metal covers used with AC induction motors, allowing a close fitting design of motor cover and blades, achieving substantial ingress protection against dust and water, thus facilitating easy cleaning.

It will be recognised that variations may be made to the ratings and efficiencies of the EC ceiling fan system components as described above, without altering the overall benefit of the approach described.

Additionally an AC:DC isolating power supply (SMPS) may be used to provide safety isolation from the incoming utility supply and to transform the line voltage to a level where the user is protected from electric shock by the low voltage level, such power supplies complying with IEC Safety Extra Low Voltage and/or UL1310 Class 2 limits. The power supply may be separated from the motor, in a sealed portion of the mounting tube.

Additionally low voltage auxiliary modules may be attached to the fan, with a mounting method that is low cost, easily accessible, and safe for installation by any ordinary person, not requiring specific electrical training, qualifications or registration.

In a first particular expression of the invention there is provided a ceiling fan as claimed in claim 1, 17 or 24.

In a second particular expression of the invention there is provided a method as claimed in claim 27.

BRIEF DESCRIPTION OF DRAWINGS

One or more example embodiments of the invention will now be described, with reference to the following figures, in which.

DETAILED DESCRIPTION

Figure 1A:
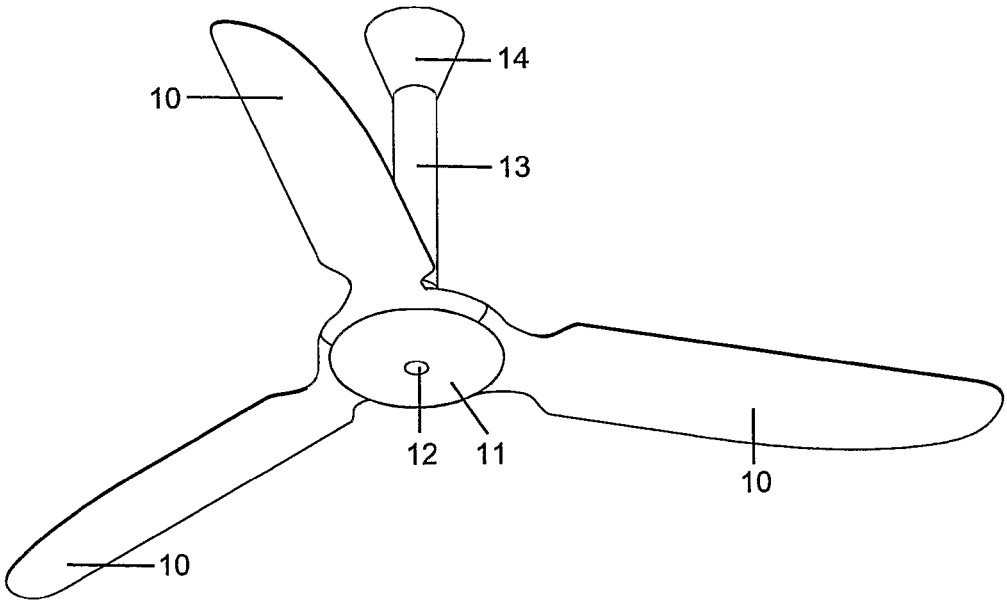
FIG. 1*a* shows a perspective view of the TENV ceiling fan, viewed from below.
Figure 1B:
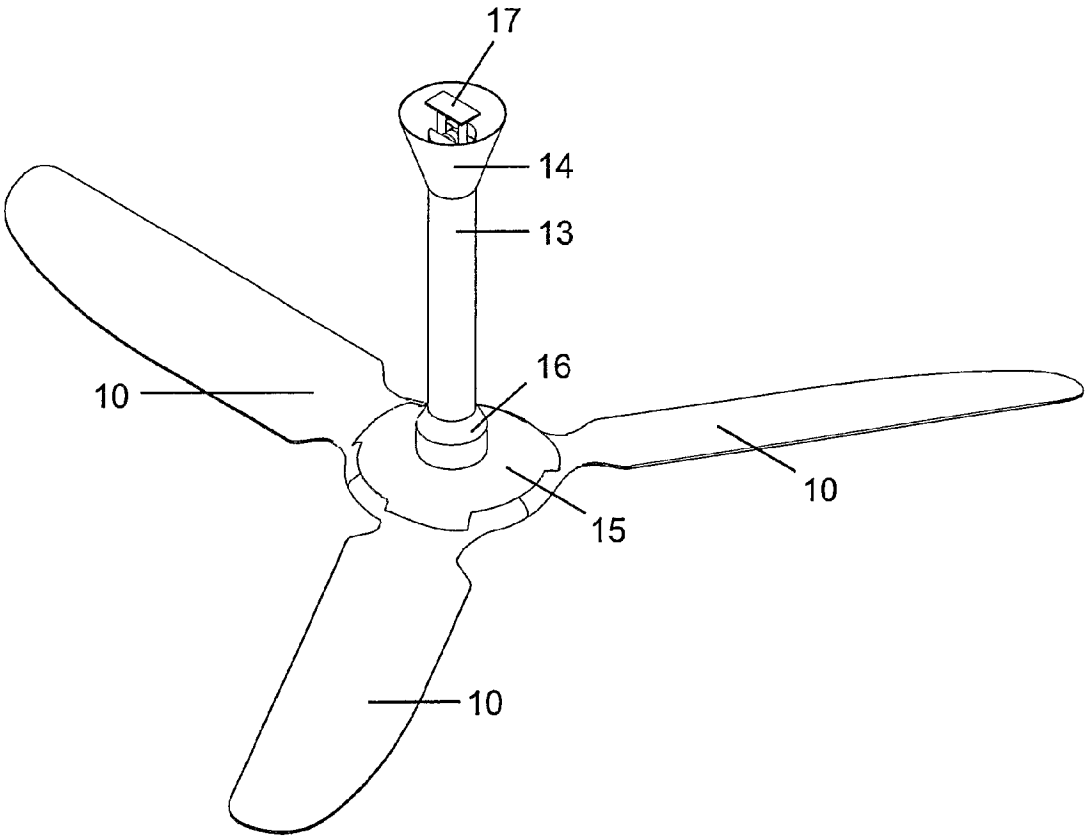
FIG. 1*b* shows a perspective view of the TENV fan viewed from above.

FIGS. 1*a* and 1*b* show a TENV ceiling fan according to an exemplary embodiment. Three fan blades 10 are mounted radially around a central tube assembly 13, with a lower cover 11 with centrally located Infra-Red LED lens 12, fitting tightly to the lower edges of the blades 10, to provide reasonable ingress protection against dust and water from below.

FIG. 1*b* illustrates a wiring cover 14 fitted over the top of the tube 13, to conceal the ceiling U-hanger bracket 17. An upper motor cover 15 is located to fit tightly to the upper edges of the blades to provide reasonable ingress protection against dust and water from above.

Figure 2:
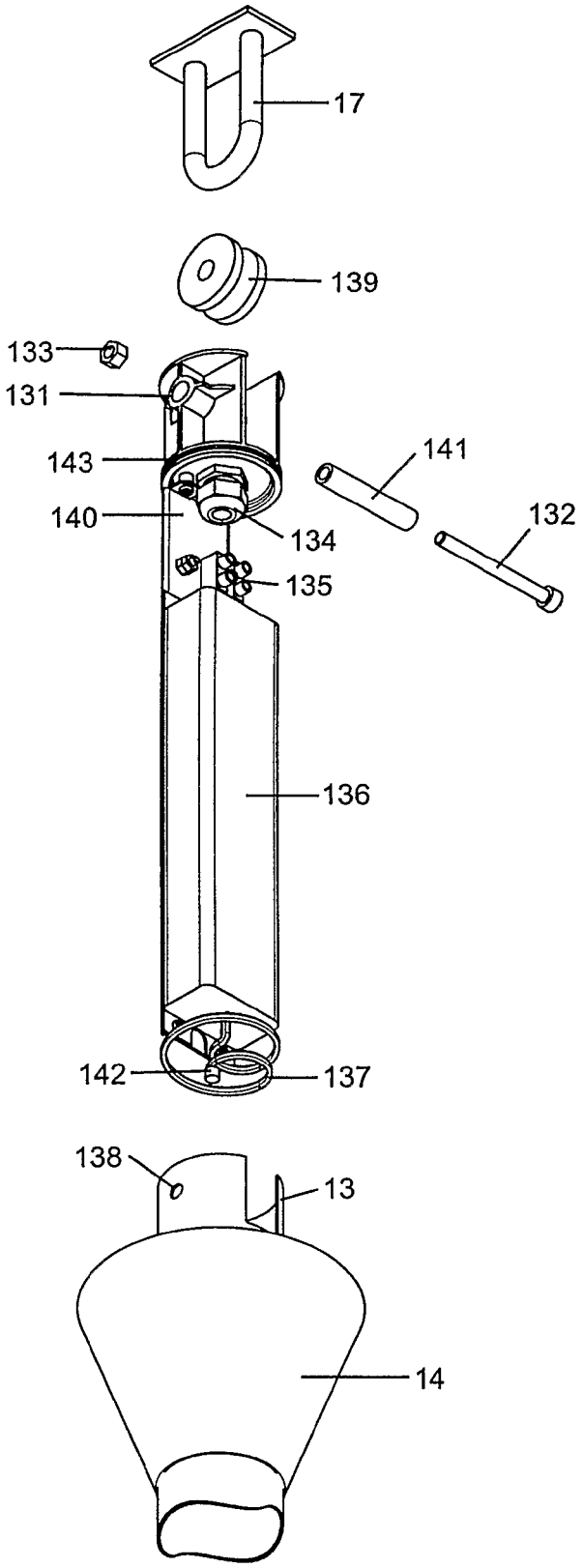
FIG. 2 shows an exploded perspective view of the tube assembly 13.

FIG. 2 shows an exploded view of the internal components of the tube assembly 13. A tube cap 131 is provided having a clearance hole for a bolt 132, so that when the tube 13 is in its assembled position, bolt 132 passes through tube holes 138, tube cap 131, spacer 141, rubber bush 139 and ceiling U-hanger bracket 17, and is fastened by a nut 133 on the opposite side of the tube 13 to suspend the tube assembly 13 from the ceiling U-hanger bracket 17.

Spacer 141 is provided to prevent excessive force being applied to tube 13 or tube cap 131 when nut 133 is fully tightened.

Tube cap 131 has a groove on the lower edge in which a rubber o-ring 143 is mounted to seal against the tube 13 inside wall, providing a substantial degree of protection against water ingress via this junction.

Access to the internal sealed portion of the tube 13 for external wiring connections is provided by cable gland 134, which seals the cable entry against water ingress.

Incoming mains wiring is terminated inside the sealed portion of tube 13 on terminal block 135, so that no live terminals are externally exposed and the tube 13 top end and U-hanger 17 may be obscured by sliding plastic wiring cover 14 up to near the top of tube 13, without the need for screw fasteners to attach it to the tube 13 for safety reasons.

Alternatively flying leads may be brought out from the terminal block 135 through cable gland 134, for termination externally where this is required.

Below terminal block 135 a switched mode power supply (SMPS) module 136 is mounted, which provides a regulated DC supply voltage to provide power to the motor and control circuitry and auxiliary modules.

The SMPS has a nominal output voltage of 12Vdc and complies with EN60950-1:2002 Safety Extra Low Voltage (SELV) rating or equivalent, providing 2 levels of electrical insulation protection against hazardous voltages on the AC line voltage input, and limiting the maximum output voltage under fault conditions.

Alternatively the SMPS output power may be limited in accordance with US National Electrical Code ANSI/NFPA70 Class 2 Power Source limitations as described in Underwriters Laboratory Standard UL1310 Edition 5.

Output voltages other than 12Vdc may be employed, for example voltages lower than the 60Vdc limits specified by SELV and/or UL1310 Class 2 or equivalent, which may protect against the risk of electric shock by the low level of voltage employed and 2 levels of electrical insulation from the incoming line voltage AC supply.

The SMPS is mounted to a vertical gearplate 140, which is attached to tube cap 131 and is entirely enclosed by tube 13. The SMPS 136 is shown as a fully enclosed module, however it will be recognised that the sealed tube arrangement would also fulfil the safety requirements necessary for an unenclosed, or open frame, SMPS module to be employed in this location.

The SMPS output lead 137 is shown coiled in its position when the fan is fully assembled, the coils providing sufficient length so that the plug 142 protrudes below the bottom of tube 13, allowing it to be plugged into the motor assembly during installation.

The SMPS 136 has a typical efficiency of 80% resulting in 5 W of losses being dissipated in the hanger tube 13 at the rated input power of 25 W. The remaining losses of 5 W are dissipated in the motor stator 350 and PCBA 351. So, compared with a typical ac induction motor the total power dissipated within the motor housing has been reduced from 60 W to around 5 W.

Both motor 30 and SMPS 136 have a full load temperature rise of around 30 degrees Celsius, so if both were enclosed within the motor housing their ambient operating temperature could be expected to increase by almost 30 degrees C. The life expectancy of electronic components and assemblies may approximately double with every 10 degree Celsius reduction in operating temperature, so separating the SMPS 136 and motor 30 assemblies may increase the life expectancy by a factor of between 4-8 times.

The tube 13 may be formed from a metallic material to enhance heat conduction between air circulating within the tube 13 due to thermal convection, and air circulating outside the tube due to rotation of the fan blades 10.

Thus the tube 13 may perform three functions; firstly to physically suspend the fan from its ceiling mounts; secondly to provide an enclosure for an SMPS module 136, and; thirdly to dissipate the SMPS power loss component and remove this heat source from the motor housing.

It will be recognised that the benefits of the above construction may apply regardless of the power rating of motor 30 and SMPS module 136, so that the SMPS rating may be substantially higher than that required by the motor alone, and surplus rating may be used to power additional LED lighting outside the fan assembly.

Figure 3A:
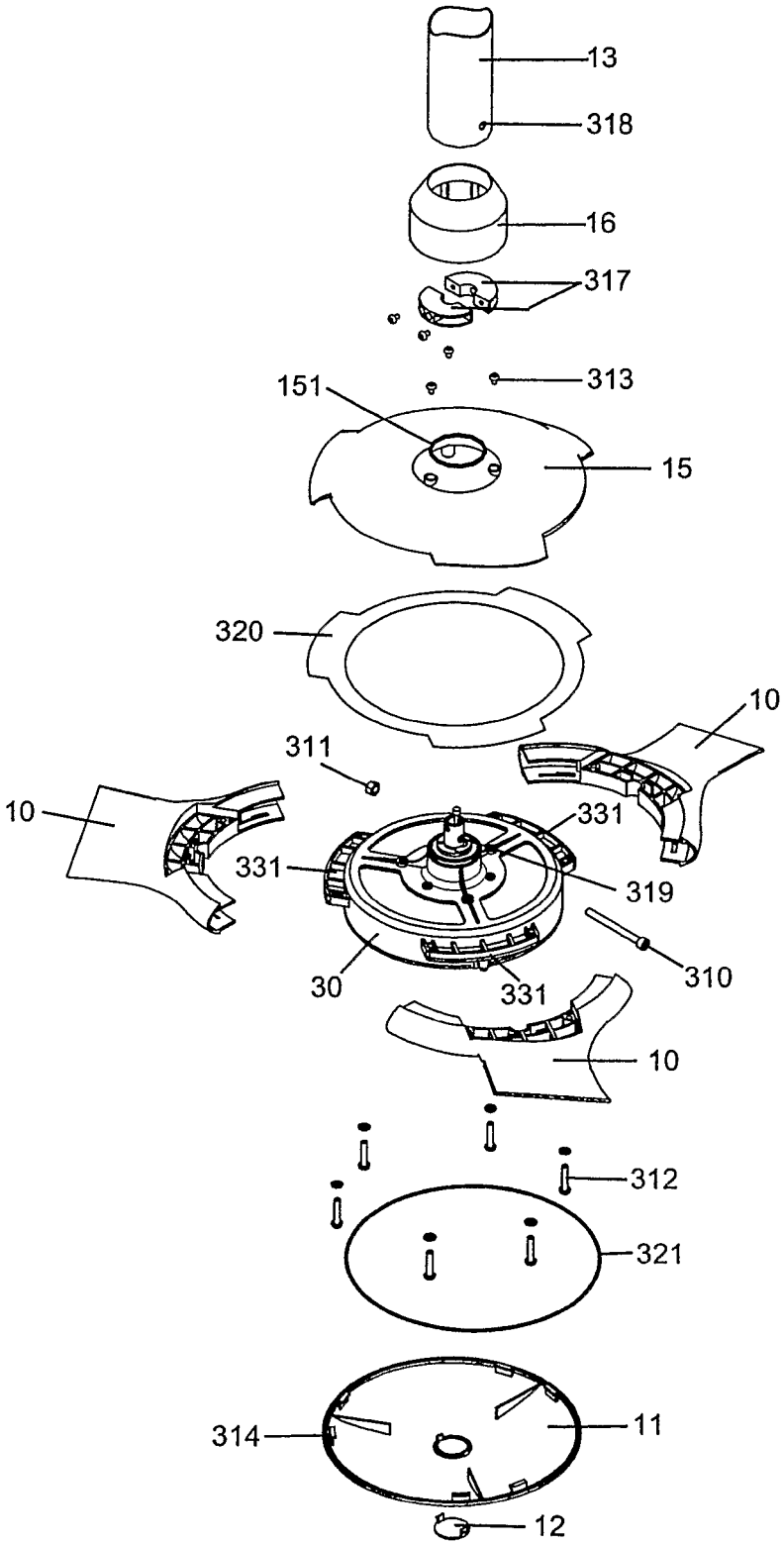
FIG. 3*a* shows an exploded perspective view of mounting details for the blades 10, upper cover 15, EC motor 30.
Figure 3B:
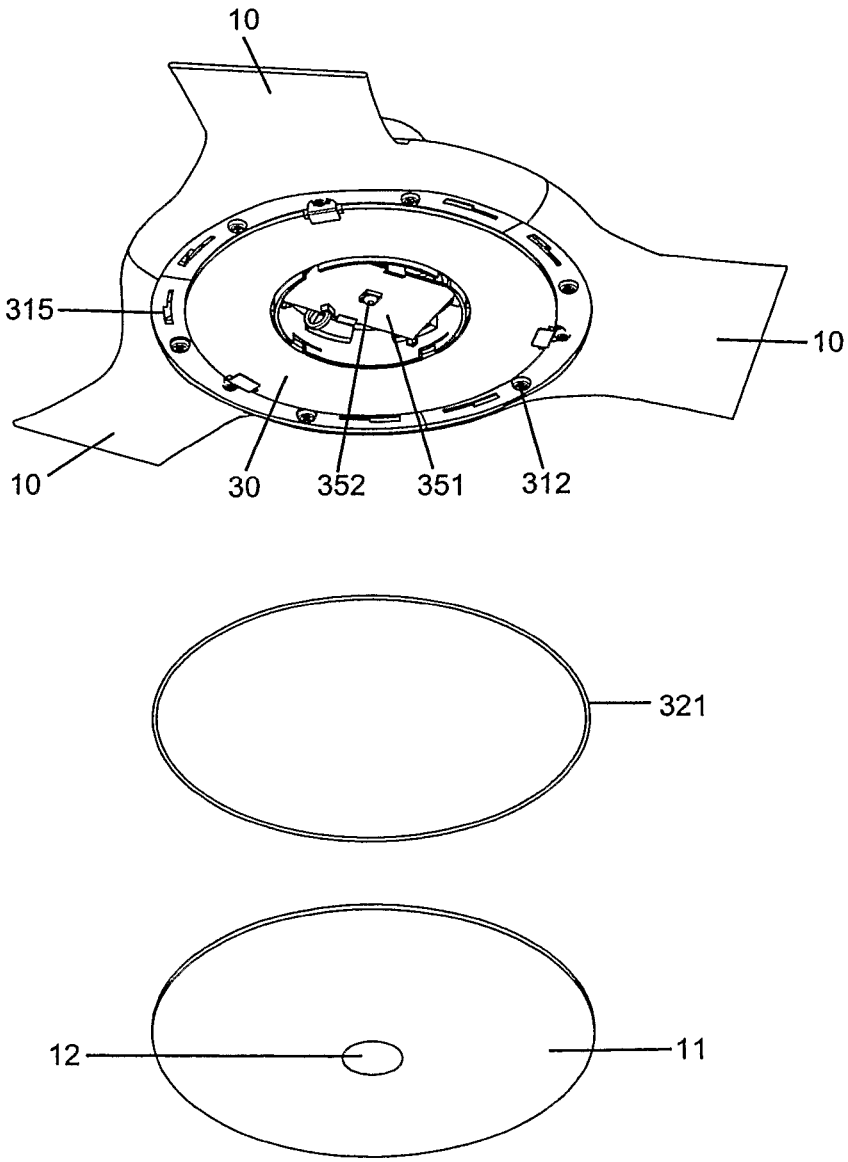
FIG. 3*b* shows a partial perspective view of mounting slots 315 in the fan blades 10 for securing the lower cover 11 via bayonet fasteners 314.

FIGS. 3*a* and 3*b* show an exploded view of the blade mounting arrangements. Blades 10 align with motor 30 blade mount webs 331, and are fastened in position by screws 312. A thin silicon rubber gasket 320 seals the interface between the blade 10 upper surface, the blade mount web upper surface 331, and is held in place by the upper motor cover 15, which is attached to the motor body 30 by screws 313. Gasket 320 provides ingress protection against dust and water. Alternatively blades 10 and upper cover 15 may be integrally injection moulded from plastics and/or gasket 320 may be formed directly on the upper motor cover 15 by silicon injection overmoulding.

Two lower tube hubs 317 are clamped around the shaft to form a circular hub with a clearance hole aligning with hole 319 in the motor shaft.

Tube 13 slides over the lower hubs 317 and bolt 310 is pushed through the tube lower mount hole 318, and shaft hole 319 to secure the assembly together with nut 311. Cover 16 slides down the tube 13 to conceal the bolt 310 and nut 311, and to restrain the bolt from 310 from sliding out of position should the nut 311 become loose.

Infra-Red LED Lens 12 clips into a central aperture in lower cover 11, which mounts to the underside of the blades 10 via raised turrets 314.

FIG. 3*b* shows that the lower cover 11 raised turrets 314 can be aligned with mounting slots 315, so that the cover 11 can be pushed vertically upwards and rotated to lock into position. Rubber o-ring 321 is compressed between the upper lip of lower cover 11 and the lower surface of blades 10 to provide ingress protection against dust and water.

Figure 4:
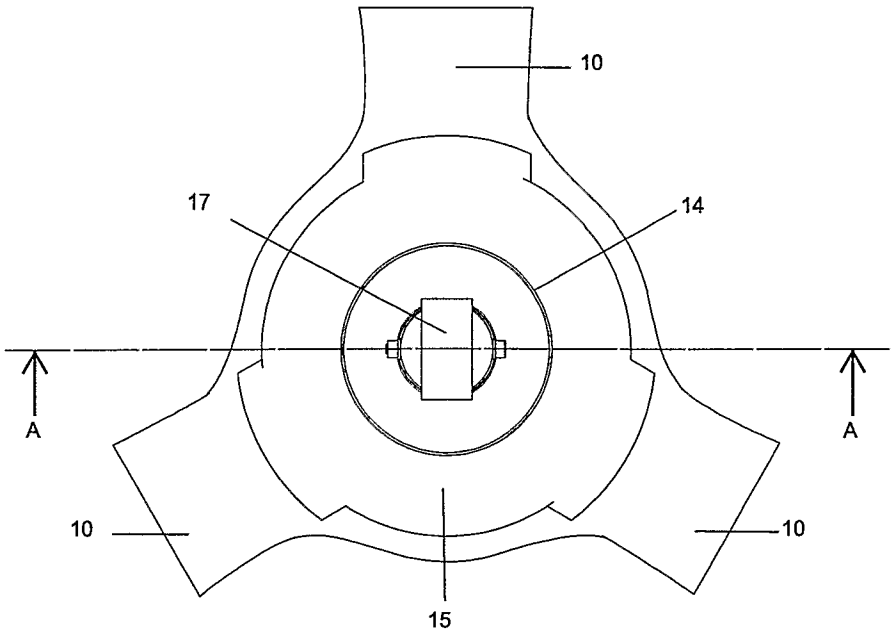
FIG. 4 shows a plan view of the fan assembly with blades cropped, indicating section cut line A-A.
Figure 5A:
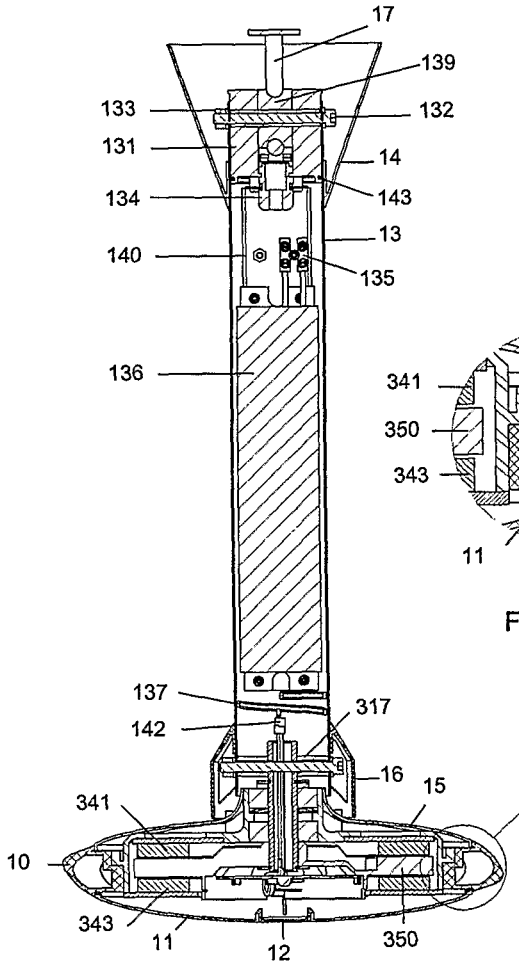
FIG. 5*a* shows section elevation A-A of the motor and shaft assembly.

FIG. 4 shows a plan view of the complete fan assembly and FIG. 5*a* which shows a section elevation indicated by sections lines A-A, tube 13 lower lip overlaps upper motor cover 15 turret 151, which prevents water from running down tube 13 and entering the motor assembly. Cover 16 further shields the motor mounting system against direct water spray at this junction.

Figure 5B:
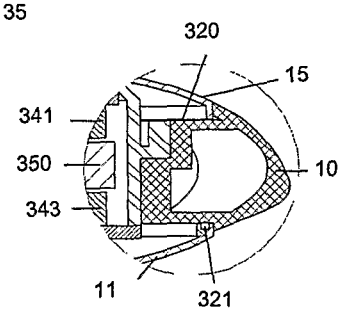
FIG. 5*b* shows enlarged detail B of section elevation FIG. 5*a*.

FIG. 5*b* shows detail B of section elevation FIG. 5*a* ingress protection between the upper motor cover 15, blades 10 and blade mount webs 331 is achieved by gasket 320, which is compressed between the opposing surfaces when upper cover 15 is tightened via screws 313. Ingress protection between the blades 10 and lower cover 11 is achieved by o-ring 321, which is compressed when cover 11 is twisted into position.

The sealing method in FIGS. 5*a* and 5*b* may provide a safe attachment method without requiring fasteners and provides a reasonable degree of protection against water and dust ingress into the motor assembly 30, such as IP55. It will be recognised that other degrees of IP protection may be achieved with minor variations to the sealing arrangements described above.

Figure 6A:
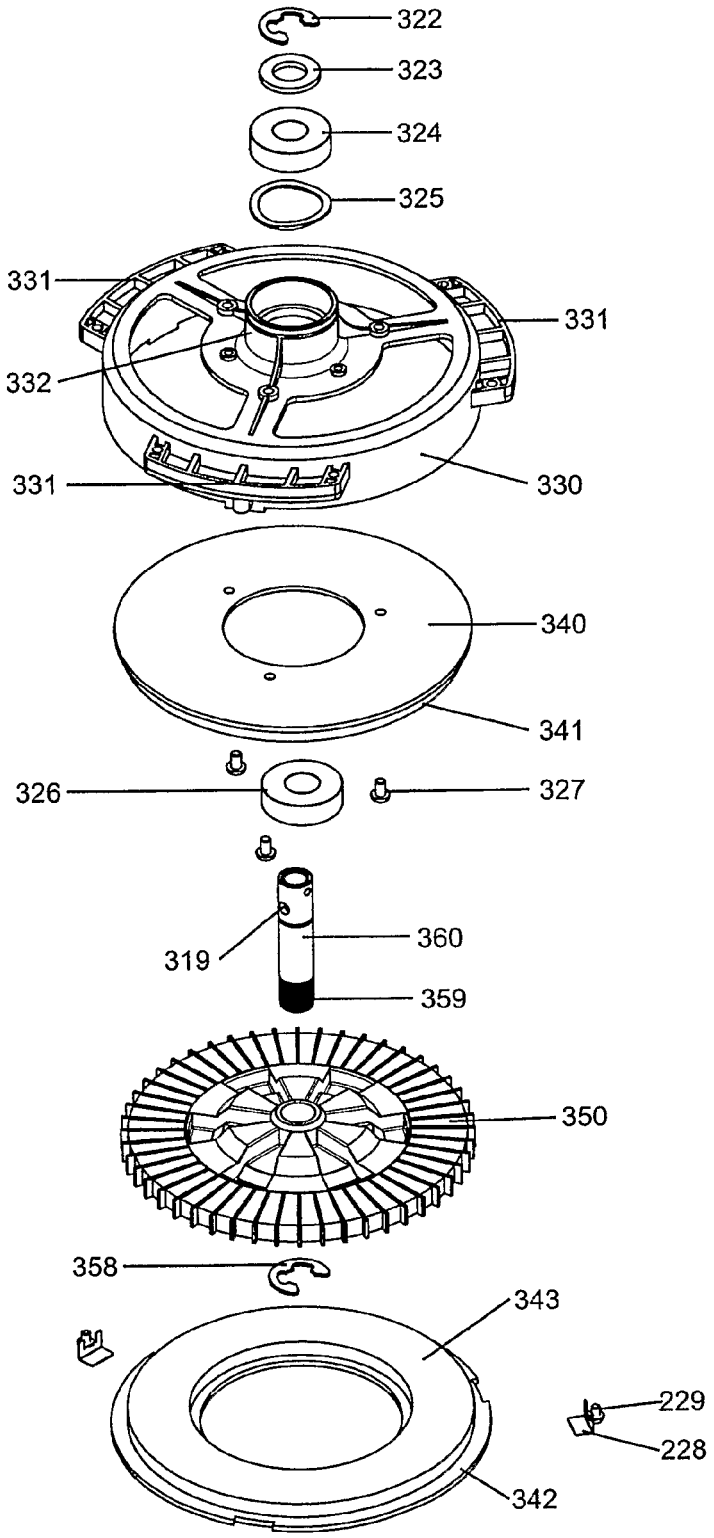
FIG. 6*a* shows an exploded perspective view of the EC motor 30.

FIG. 6*a* shows an exploded view of EC motor 30, the motor is an external rotor, slotless, axial flux, double rotor configuration, commonly referred to as a TORUS motor.

The motor 30 includes a rotor shell 330 which may be formed from non-ferromagnetic material of suitable strength, such as diecast aluminium or injection moulded thermoplastic, and provides blade mount webs 331 and a bearing turret 332 which provides mounting for upper bearing 324 and lower bearing 326. Alternatively, rotor shell 330 and upper cover 15 may be formed as a single integrated component.

The upper rotor 340 comprises an annular disk of ferromagnetic material, and an annular magnetic ring 341, composed of permanent magnetic material, glued into position and magnetised with 16 equispaced magnetic pole sectors facing the stator 350 upper surface. The upper rotor 340 is attached to the rotor shell 330 from the inside of the motor by 3 mounting screws 327.

The stator 350 has a plastic injection moulded core with the main motor shaft 360 pressed in to position and retained by splines 359 and circlip 358.

The rotor shell 330, fitted with upper rotor 340, bearings 324 and 326, is slid into position down shaft 360 and retained in position by circlip 322 and washer 323. Wave washer 325 provides bearing preload.

The lower rotor 342 comprises an annular disk of ferromagnetic material, with an annular magnetic ring 343, composed of permanent magnetic material, glued into position and magnetised with 16 equispaced magnetic pole sectors facing the stator 350 lower surface.

Both upper 341 and lower 343 ring magnets are preferably of ceramic magnetic material, which is widely available at low cost as used in loudspeaker ring magnets. Alternatively, a complete ring may be formed from multiple magnet segments. Alternatively rare earth Neodymium Iron Boron or other high strength permanent magnet materials may be used, either in complete rings or formed from multiple magnet segments.

Figure 6B:
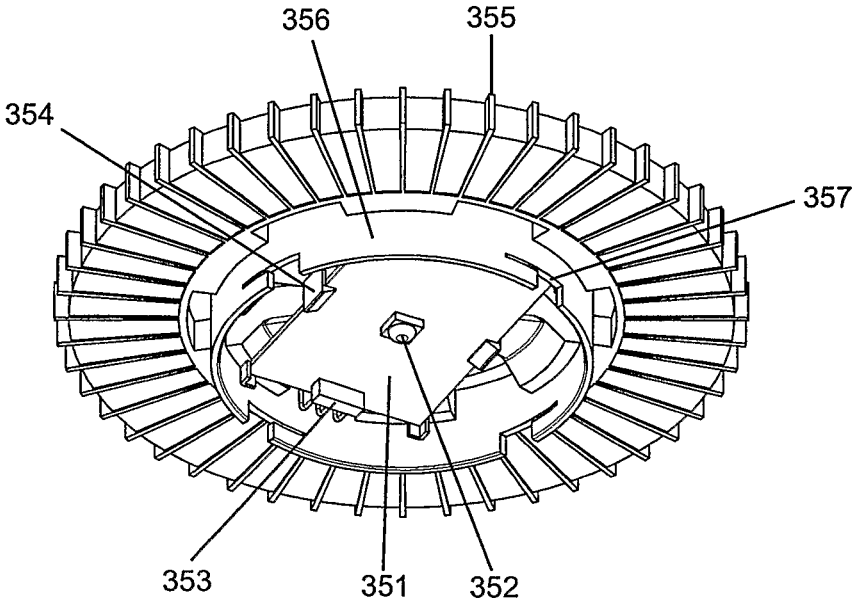
FIG. 6*b* shows perspective detail of EC motor stator 350, viewed from below.

FIG. 6*b* shows perspective detail of the stator 350 lower surface, the stator 350 is toroidally wound with a 16 pole 3 phase winding, comprising 15 turns per pole of 0.9 mm diameter enamelled copper magnet wire. Stator teeth 355 are formed from injection moulded thermoplastic material, used for the purpose of guiding the magnet wire during winding, and do not form an active part of the motor magnetic circuit.

A moulded turret 356 extends from the lower surface of the stator core, and provides a housing for PCBA 351 which is retained in position by mounting clips 354. The stator windings terminate directly to the PCBA via loom and plug 353. Moulded stator turret 356 has 4 radial keyway cutouts 357 which provide a bayonet mounting system for auxiliary modules such as the LED lighting module 18 shown in FIG. 7 and FIG. 8.

Figure 7:
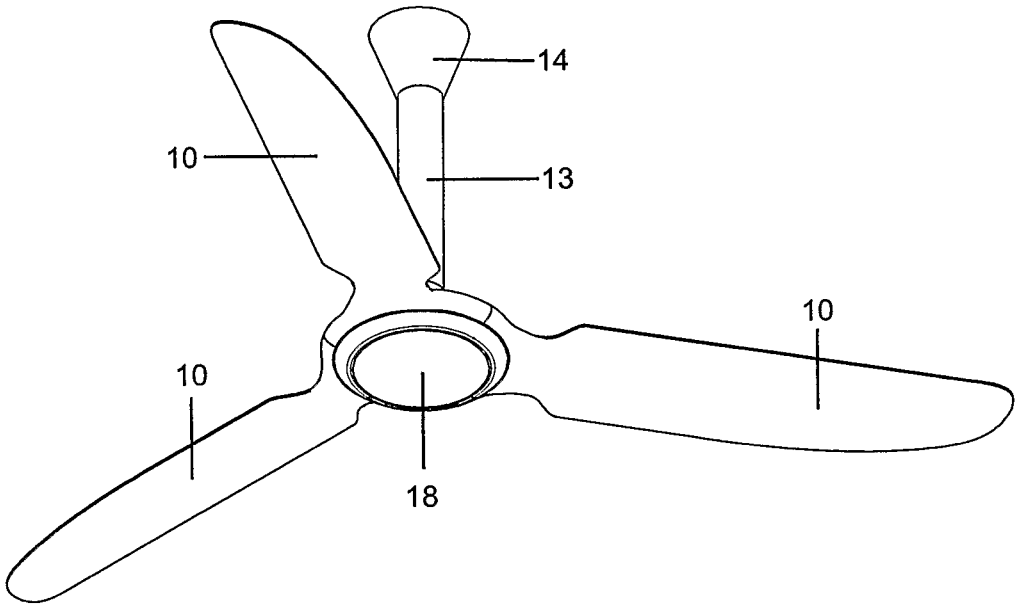
FIG. 7 shows a perspective view of the fan with an auxiliary LED lighting module 18 fitted in place of the lower cover 11.

FIG. 7 shows a perspective view of the fan with LED module 18 fitted in place of cover 11, it will be noted that since LED module 18 is now stationary and the blades 10 revolve around it, a small mechanical clearance gap may be required between the outer lip of module 18 and blades 10.

Figure 8:
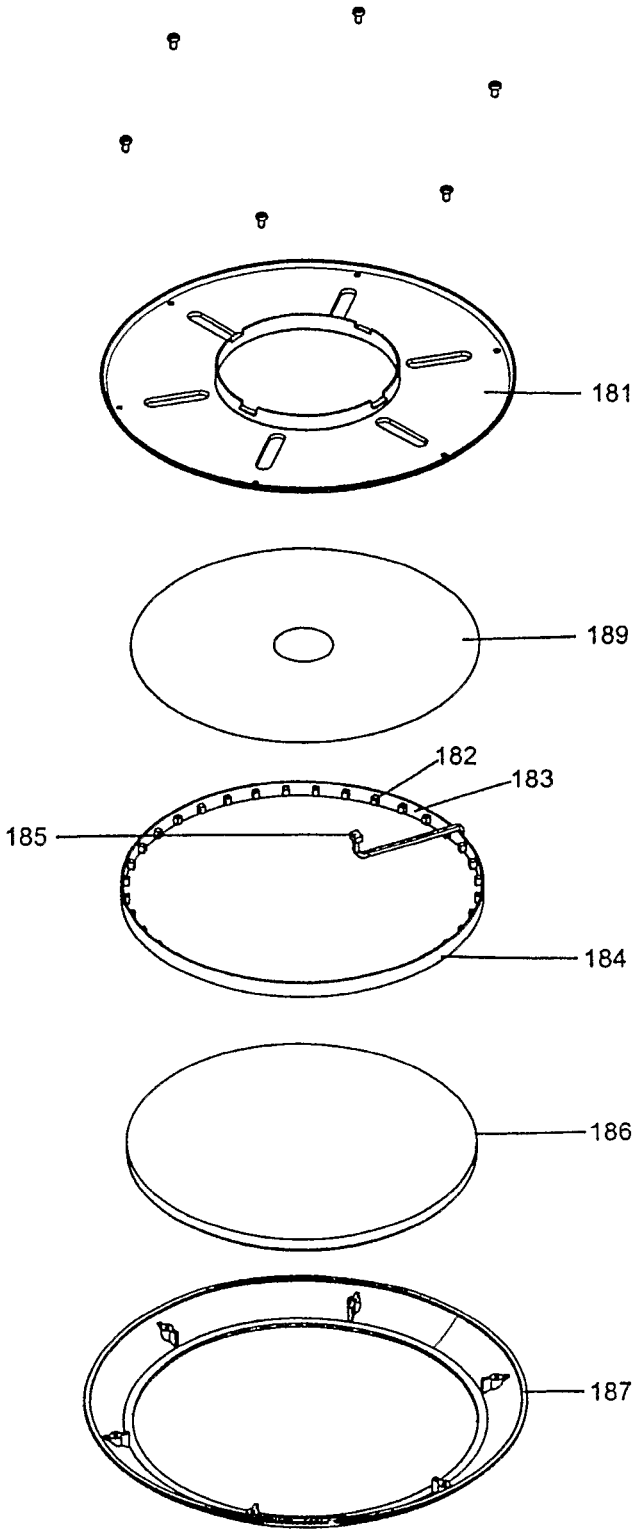
FIG. 8 shows an exploded view of the LED lighting module 18.

FIG. 8 shows an exploded view of the LED lighting module 18, a plurality of LEDs 182 are mounted on a flexible circuit substrate 183, and attached by means of double sided adhesive tape to the inside diameter of a circular metallic strip 184. Electrical connection to the circuit 183 is made via a flying lead with plug 185, which can be plugged directly into the PCBA 351 during installation. Alternatively a connector may be provided that engages as the LED module 18 is located in position within the stator 350.

The LED ring 183 directs light radially inwards from the outer circumference of a transparent circular lens 186. Lens 186 is composed of acrylic material, such as Plexiglas Endlighten, which allows relatively uniform illumination of the lens area when lit from the edges. The lens 186 is positioned centrally in the lower LED cover 187, with the LED ring 184 around its circumference, and the assembly clamped together by LED mounting plate 181.

A thin reflector sheet 189 is located between the lens 186 and mounting plate 181, and has a central clearance hole to allow control signals from an infra-red transmitter to pass through to infra-red receiver 352, mounted directly on PCBA 351. The reflector sheet 189 has a substantially reflective surface in contact with the lens 186 to maximise light intensity directed in the downwards direction. Alternatively the reflector sheet may have a pattern, message, picture or logo printed on its lower surface, which will be visible from the underside of the fan and which can be used for display, advertising or decorative purposes. Since the LED module 18 can be easily and safely removed by the user, the reflector sheet 189 can be easily replaced from time to time.

Figure 9:
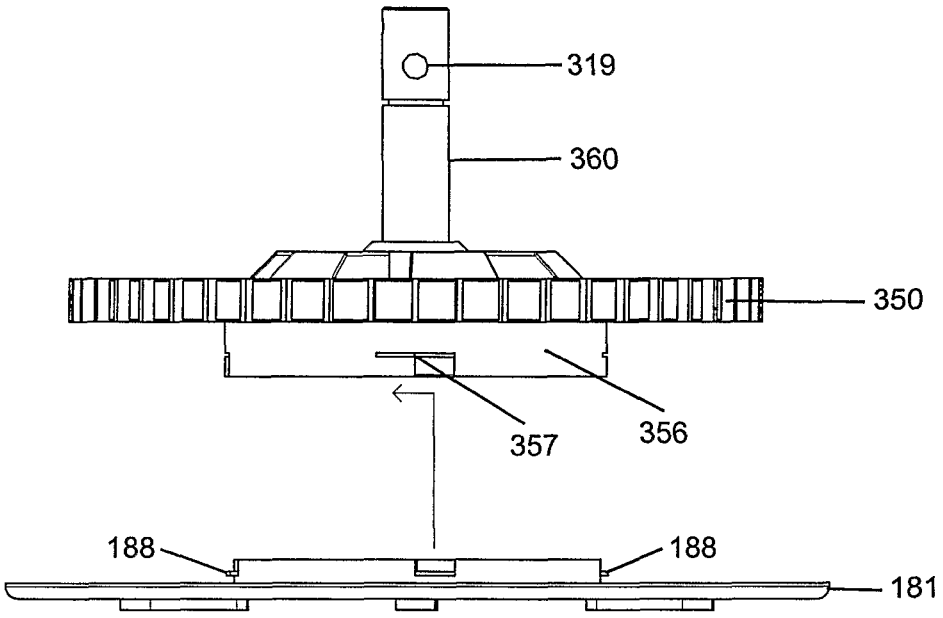
FIG. 9 shows an elevation view of the mounting arrangements between the stator 350 and LED lighting module baseplate 181.

FIG. 9 shows an elevation view of the mounting arrangements between the stator 350 and LED lighting module 18, folded tabs 188 on the baseplate 181 align with keyhole slots 357 in lower stator turret 356.

When the tabs 188 align with slots 357, the LED module 18 can be raised into position and rotated to engage the tabs 188 with the thin portion of slots 357, locating the LED module 18 in position.

The auxiliary LED module 18 thus described provides indirect illumination via an edge lighting system with white LEDs. Alternatively other LED colours e.g. red, green, yellow, blue may be used either individually or in combination. Alternatively, multiple high brightness LEDs can be employed, oriented axially downwards for improved illumination for direct downlighting purposes. Alternatively, auxiliary modules with other functions may be provided, for example smoke detectors, alarm motion sensors, as long as these share the described mounting system and 12Vdc operating voltage requirements.

Thus, a single fan model may provide the benefits of either totally enclosed operation, or user installable auxiliary modules, with a simple mechanical interface system and a high degree of electrical safety.

Figure 10:
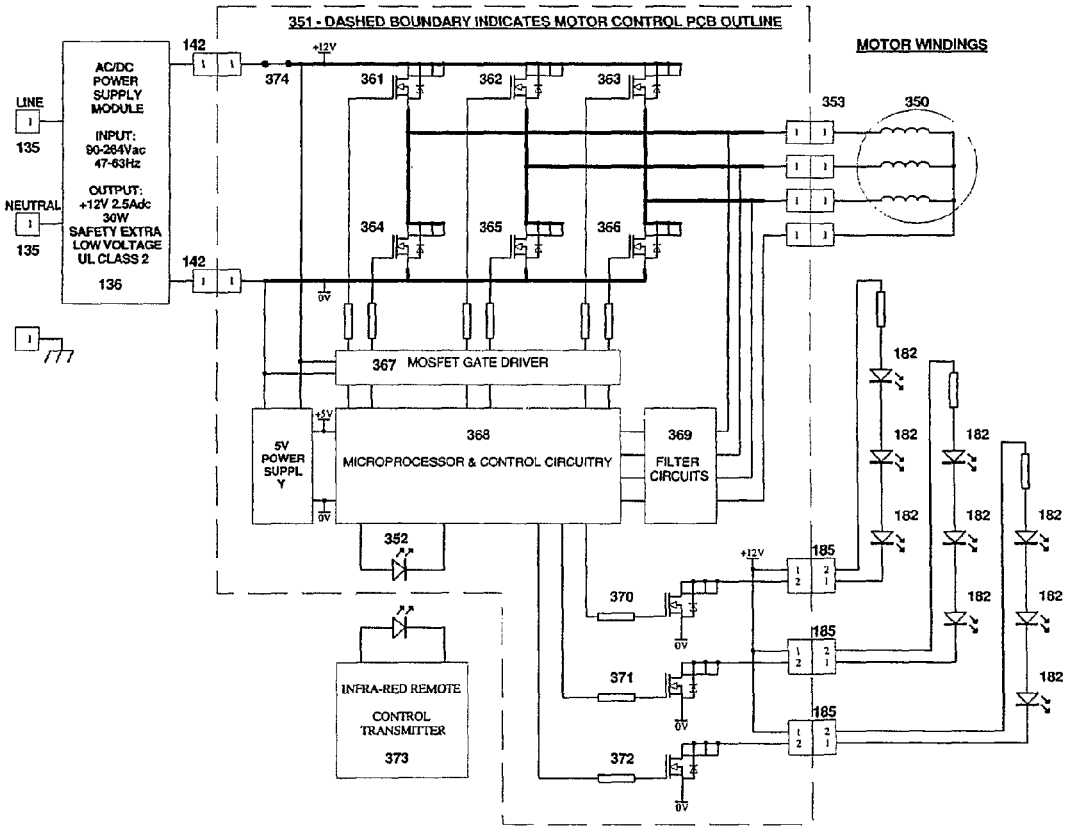
FIG. 10 shows an electrical block schematic of the power supply 136 and printed circuit board assembly (PCBA) 351.

FIG. 10 shows an electrical block diagram of the power supply 136, printed circuit board assembly (PCBA) 351, Infra-Red receiver 352, motor stator windings 350 and LED strip assembly 182.

SMPS 136 provides a 12Vdc supply to controller printed circuit board 351. The SMPS 136 provides output current and overload protection for the 12Vdc supply rail. A thermal switch 374 is provided on the controller PCB to disconnect power to the controller should internal temperature exceed safe limits, due to a motor or controller fault or excessive ambient temperature.

Motor windings are energised via a 3 phase mosfet inverter 361-366. Mosfet gate drive signals are boosted from microprocessor logic voltage levels by an integrated level-shifter driver 367. Motor speed is regulated by pulse-width-modulation (pwm) of the mosfet gate drive signals under the control of microprocessor 368. The motor winding 350, phase voltages are applied to filter circuits 369 to attenuate the signal voltage level and reduce noise, and these signals are used to implement back-emf sensing commutation control of the mosfet inverter to ensure windings are energised in the correct sequence and in the desired direction.

Electronic protection is provided via the microprocessor software to detect motor stall or abnormal operating conditions and shutdown.

User control of fan functions is implemented via an Infra-Red remote control transmitter 373, with control signals received by Infra-Red receiver 352, mounted directly on motor controller PCBA 351. Alternatively a radio frequency (RF) remote control transmitter and input module and may be used.

Three auxiliary output channels 370, 371, 372 are provided to supply switched power to the auxiliary LED lighting module 18 via connector assembly 185. In the preferred embodiment the auxiliary outputs allow the LED lighting to be switched on/off by the user remote control. Alternatively more sophisticated control options, such as flashing, Red-Green-Blue colour sequencing, can be programmed into the microprocessor 368 and activated by the user remote control 373. Alternatively the auxiliary outputs may be used to control LED lighting modules external to the ceiling fan assembly.

Whilst exemplary embodiments of the invention have been described in detail, many variations are possible within the scope of the invention as will be clear to a skilled reader.

The invention claimed is:

1. A ceiling fan comprising
a fan motor and blade assembly,
a mounting tube for suspending the fan motor and blade assembly from a ceiling, and
a switched mode power supply (SMPS) mounted and fully enclosed within the mounting tube configured to power the fan motor.

2. The ceiling fan in claim 1 wherein the SMPS is configured to output a safety extra low voltage to power the fan motor.

3. The ceiling fan in claim 1 wherein the SMPS is configured to output a voltage less than or equal to 60V to power the fan motor.

4. The ceiling fan in claim 1 wherein the SMPS has 2 levels of output isolation.

5. The ceiling fan in claim 1 wherein the fan motor is an electrically commutated (EC) motor.

6. The ceiling fan in claim 5 wherein the fan motor comprises a double rotor, axial flux toroidally wound (TORUS) motor.

7. The ceiling fan in claim 5 further comprising a motor controller configured to control the fan motor using back emf sensing.

8. The ceiling fan in claim 1 further comprising a sealing arrangement within the fan motor and blade assembly providing ingress protection against dust and water incident from at least an underside thereof.

9. The ceiling fan in claim 8 wherein the ingress protection is one of at least water jets incident from at least the underside of the fan motor and blade assembly.

10. The ceiling fan in claim 1 further comprising a mounting on the underside of the fan motor and blade assembly for mounting a changeable auxiliary module.

11. The ceiling fan in claim 10 wherein the mounting is provided integrally moulded with a moulded stator frame.

12. The ceiling fan in claim 11 wherein the mounting is configured to enclose and mount:
a motor controller for the fan motor, and
the changeable auxiliary module.

13. The ceiling fan in claim 10 wherein the changeable auxiliary module is a lighting module.

14. The ceiling fan in claim 1 further comprising a remote control configured to receive a desired speed of the fan motor input by a user.

15. The ceiling fan in claim 14, wherein the remote control is configured to receive a desired state of the lighting module input by a user.

16. The ceiling fan in claim 1, wherein the mounting tube is secured to an upper part of the fan motor and blade assembly.

17. The ceiling fan in claim 1, wherein the mounting tube is secured to a fan motor housing.

18. The ceiling fan in claim 1, wherein the fan motor and blade assembly comprises blades secured to an outer surface of the fan motor.

19. The ceiling fan in claim 1, wherein the mounting tube comprises an open lower end above the fan motor and blade assembly.

20. A fan mounting from a ceiling, comprising:

a fan motor having a fan motor housing and connected to a plurality of fan blades;

a mounting tube extending between the fan motor housing of the fan and the ceiling for suspending the fan motor from the ceiling, and a switched mode power supply mounted and fully enclosed within the mounting tube configured to power the fan motor.

21. The fan of claim 20, wherein the tube includes a hanger for hanging the fan motor from the ceiling.

22. The fan of claim 20, further including a lead depending from the power supply for supplying power to the fan motor.

23. The fan of claim 22, further including a tube extending at least partially within the motor housing for receiving the lead.

24. The fan of claim 20, wherein the switched mode power supply is connected to at least one plug.

25. The fan of claim 20, wherein the mounting tube includes an open lower end above the fan motor.

26. A fan mounting from a ceiling, comprising:

a fan motor having a fan motor housing including an upper surface, said fan motor being adapted for rotating a plurality of blades;

a mounting tube for suspending the fan motor from the ceiling, and a switched mode power supply for supplying power to the fan motor, said switched mode power supply fully enclosed by the mounting tube.

27. The fan of claim 26, wherein the switched mode power supply is connected to at least one plug.

28. The fan of claim 26, further including a lead depending from the power supply for supplying power to the fan motor.

* * * * *

UNITED STATES PATENT AND TRADEMARK OFFICE

CERTIFICATE OF CORRECTION

PATENT NO. : 8,770,949 B2
APPLICATION NO. : 13/061781
DATED : July 8, 2014
INVENTOR(S) : Noble It is certified that error appears in the above-identified patent and that said Letters Patent is hereby corrected as shown below:

In the claims

Column 9, line 4, please insert -- for -- after fan.

Column 10, line 5, please insert -- for -- after fan.

Signed and Sealed this
Twelfth Day of January, 2016

Michelle K. Lee

Michelle K. Lee
*Director of the United States Patent and Trademark Office*